US005441368A

United States Patent [19]

Campbell et al.

[11] Patent Number: 5,441,368

[45] Date of Patent: Aug. 15, 1995

[54] ANTI-FOULING APPARATUS FOR SUBMERGED MARINE SURFACES

[76] Inventors: Colin C. Campbell, R.R. #1, Georgetown, Ontario, Canada, L7G 4S4; W. Donald Casselman, 94 Mary Street, Georgetown, Ontario, Canada, L7G 4V6

[21] Appl. No.: 116,705

[22] Filed: Sep. 7, 1993

[51] Int. Cl.[6] ..... E02B 17/00; B63B 59/00

[52] U.S. Cl. ..... 405/211; 114/222; 405/52; 405/127

[58] Field of Search ..... 405/22, 52, 60, 61, 405/62, 195.1, 211, 218, 127; 114/221 R, 222

[56] References Cited

U.S. PATENT DOCUMENTS

| | | | |
|---|---|---|---|
| 3,083,538 | 4/1963 | Gross | 405/61 |
| 3,585,802 | 6/1971 | Frankel | 405/211 |
| 3,773,059 | 11/1973 | Arneson | 114/222 X |
| 3,855,367 | 12/1974 | Webb | 405/52 X |
| 4,077,225 | 3/1978 | Lichtenberger et al. | 405/211 |
| 4,957,392 | 9/1990 | Bailard et al. | 405/22 X |
| 5,017,093 | 5/1991 | Naes | 405/61 X |
| 5,152,637 | 10/1992 | Wayne | 405/211 X |
| 5,256,310 | 10/1993 | Brooks | 405/211 X |

*Primary Examiner*—David H. Corbin
*Attorney, Agent, or Firm*—Patrick J. Hofbauer

[57] ABSTRACT

An anti-fouling apparatus and method for retarding the formation of marine plants and animals on marine surfaces submerged in water is disclosed. Telescopically extendable support arm members in the form of pneumatic struts are pivotally mounted on a mounting bracket for selective movement between a first raised position, at which the distal end is raised out of the water, and a second lowered position, at which the distal end is submerged in the water. A selectively energizable water propulsion means, which includes an electrically powered motor and a propeller, is operatively mounted on the support arm member adjacent to the distal end so as to be submerged in the water when the support arm is in the second lowered position. A shroud member defining an internal throughpassage between an inlet end and an outlet end, surrounds the water propulsion means so as to direct a propelled water stream through the throughpassage in generally parallel relation to the longitudinal axis of the shroud member, generally toward the submerged marine surface when the water propulsion means is energized and the support arm member is in the second lowered position. A pneumatically actuated rotary motor controls the movement of the support arm member between the first raised and the second lowered positions such that the support arm member is automatically raised when the ignition of the boat is turned on and is automatically lowered when the ignition is turned off. An automatic timer selectively energizes the water propulsion means.

21 Claims, 6 Drawing Sheets

ANTI-FOULING APPARATUS FOR SUBMERGED MARINE SURFACES

FIELD OF THE INVENTION

This invention relates to anti-fouling devices for retarding the formation of marine plants and animals on marine surfaces submerged in water, and more particularly to such devices used to preclude the formation of algae, zebra mussels, barnacles, tube worms and the like on such marine surfaces, including boat hulls and docks. This invention also relates to a method retarding the formation of marine plants and animals on marine surfaces submerged in water.

BACKGROUND OF THE INVENTION

A marine craft, such as a boat floating in water, or a marine structure, such as a dock or a water system intake, each have surfaces that are submerged in water, thereinafter referred to as "marine surfaces". Due to their submergence in water, these marine surfaces may be affected by many types of biotic fouling contaminates. Ultimately, these biotic fouling contaminates must be physically cleaned from the marine surfaces, often at a great expenditure of labour and time.

These contaminates commonly include algae, crustaceans such as barnacles, tube worms and the like. Initially, only algae attach to the submerged marine surfaces of a marine craft or marine structure. In the case of a marine craft, the submerged surfaces include the hull and the running gear. While the formation of algae on the submerged marine surfaces may potentially be problematic, it is usually only a minor problem in most marine areas, since algae grows at a relatively slow rate.

A much more significant and serious problem is the large scale accumulation of crustaceans such as zebra mussels, barnacles, tube worms, and the like on marine surfaces. Zebra mussels, barnacles, tube worms and the like, attach themselves, in their larvae stage, to marine surfaces that have algae growing on them in order to eat the algae, as algae is a food base for such larvae. These crustacean larvae continue to feed and grow into their adult stage, where they remain attached to the same marine surface, until physically and forcibly removed.

An extremely large number of any of these larvae may attach themselves to algae covered marine surfaces due to the relatively small size of the crustacean larvae. The larvae grow quite quickly on the submerged algae covered marine surfaces, and in the matter of a few weeks, or possibly one to two months, the growing crustaceans, which may include zebra mussels, barnacles, tube worms and the like, can cover virtually all of the submerged marine surfaces of a marine craft or marine structure.

In the case of a marine craft, significant formation of algae, zebra mussels, barnacles, tube worms and the like on the hull of a boat tends to slow a boat down significantly for any given power setting, or alternatively, tends to cause very significantly increased gas consumption, corresponding to an increased power setting, which increased power setting would be required in order to maintain a given speed. The moving parts of the marine craft, such as the running gear, become more difficult to move and tend to experience a decreased range of movement. Any intakes on a marine craft, such as a water intake for the cooling system, may be partially blocked or fully blocked, which may eventually lead to problems such as engine overheating. Further, accumulations of algae, zebra mussels, barnacles, tube worms and the like on a marine craft are aesthetically displeasing.

In some areas of North America, it is required by law to have a marine craft power washed to remove zebra mussel and other biotic fouling contaminants before it is allowed to pass from one body of water, such as a lake, to another body of water. This requirement is intended to prevent the spread of zebra mussels. However, such a requirement is a great inconvenience to boaters, and also is an unwanted expense.

In order to remove zebra mussels, barnacles, tube worms and the like from a boat, they must be scraped off after the boat has been raised out of the water and placed in a dry-dock, or the like, which is a very difficult and time consuming task. The algae that remains thereon can then be washed off with a suitable cleaning substance. This process of removing the zebra mussels, barnacles, tube worms and the like is very inconvenient since the boat cannot be used for a period of time. Moreover, is relatively expensive, and must be re-done every few months, or possibly even every few weeks in warmer waters where fouling occurs more rapidly. Further, algae, zebra mussels, barnacles, tube worms and the like start forming immediately after the boat has been returned to the water, and a significant number can be attached to the cleaned boat within weeks or even days of such return.

Of more recent concern is the geographic spreading of crustaceans from native waters to waters where such crustaceans have few, or no, natural predators or parasites. Resultingly, such crustaceans are allowed to grow virtually unhindered, and can accumulate at alarming rates. Unfettered accumulations of such crustaceans can become significant, extremely quickly. Zebra mussels are not native to North America, but have been recently introduced into many North American waterways, and are geographically spreading quite rapidly. While zebra mussels are of concern even in their native waters, their presence is of very serious concern in North America.

Various conventional preventative measures have been used to preclude the formation of algae, zebra mussels, barnacles, tube worms, and the like on marine craft. A very common and partially successful way of precluding formation of algae, zebra mussels, barnacles, tube worms and the like on boats is anti-fouling paint, which is usually tin based or copper based. While these types of anti-fouling paints work reasonably well, the metal base of the paint slowly leaches into the water, thereby causing an environmental hazard. Resultingly, metal based anti-fouling paints have been banned from use by many governmental authorities.

Anti-fouling waxes may also be used with a reasonable degree of success to preclude the formation of algae, zebra mussels, barnacles, tube worms and the like. While these anti-fouling waxes do not create the environmental hazard represented by anti-fouling paints, they typically wash off within about one month or less. A further disadvantage of anti-fouling waxes is that the boat must be put into a dry-dock each time the wax is to be applied, which again is inconvenient, time consuming and expensive. Also, anti-fouling waxes are relatively expensive when used on a regular basis.

A more recent technology for precluding the growth of algae, zebra mussels, barnacles, tube worms, and the like on marine surfaces is by way of ultrasonic transducers. In use, one or more transducers, in the form of a diaphragm or magnet, are attached to, for example, the inside of the hull of a boat. The transducers are vibrated ultrasonically. This ultrasonic vibration causes the hull of the boat to vibrate ultrasonically, which thereby causes a thin layer of water adjacent the hull of the boat to also vibrate ultrasonically. Such ultrasonic vibration of the thin layer of water adjacent to the hull of the boat does not preclude algae from reaching the boat; however, it does, at least initially, preclude the zebra mussels, barnacles, tube worms and the like from reaching the initial thin layer of algae on the boat. Notwithstanding this, however, the algae continues to grow on the submerged marine surfaces of the boat, to the point where the thickness of the algae layer eventually exceeds the thickness of the ultrasonically vibrated layer of water. At this point, zebra mussels, barnacles, tube worms and the like can then begin to feed on the outer layers of algae. As the zebra mussels, barnacles, tube worms and the like grow, they become strong enough to attach to the ultrasonically vibrating submerged marine surfaces of the boat. Resultingly, it has been found that ultrasonic transducers are not overly effective in precluding the growth of algae, zebra mussels, barnacles, tube worms, and the like on marine surfaces.

Other problems with ultrasonic anti-fouling systems have also been found. Various parts of the running gear are not vibrated sufficiently, unless one or more transducers are placed directly on each part. Further, the outer bearing on the propeller shaft of a marine motor is typically made from rubber or similar resilient material, and therefore readily absorbs ultrasonic vibration. Thus, marine propellers cannot be protected to any significant degree from biotic contamination of the type discussed herein by way of ultrasonic anti-fouling devices.

Further, ultrasonic transducers are relatively expensive and are audibly detectable during operation, which is annoying.

It has been found that by continuously or intermittently causing a flow of water of a speed greater than about four miles per hour along a submerged marine surface, the formation of marine plants and animals such as algae, zebra mussels, barnacles, tube worms and the like can be substantially precluded. The frequency of use of the above stated means of precluding the formation of marine plants and animals such as algae, zebra mussels, barnacles, tube worms and the like is influenced by the severity of the local fouling conditions of the water, including salinity, Ph level, and temperature, among other factors.

It is an object of the present invention to provide an anti-fouling device for marine surfaces that substantially precludes the attachment of algae, zebra mussels, barnacles, tube worms and the like to such surfaces.

It is another object of the present invention to provide an anti-fouling device for marine craft which device precludes the need for the craft to be removed from the water in order for the device to be operative.

It is a further object of the present invention to provide an anti-fouling device for marine surfaces which device does not present an environmental hazard to the marine environment in which it is utilized.

It is an object of the present invention to provide an anti-fouling device for marine surfaces that is relatively inexpensive to operate on an ongoing basis.

It is an object of the present invention to provide an anti-fouling device for marine surfaces that is relatively simple to manufacture and install and which is, therefore, relatively inexpensive.

It is a further object of the present invention to provide a method for retarding the formation of marine plants and animals on marine surfaces submerged in water which is relatively simple and economical to perform and which is more effective over previously used methods.

SUMMARY OF THE INVENTION

In accordance with one aspect of the present invention there is provided an anti-fouling apparatus for retarding the formation of marine plants and animals on marine surfaces submerged in water. The apparatus comprises a mounting means affixed to the marine surface or to another surface adjacent to the marine surface. A support arm member having a proximal end and a distal end, is operatively mounted on the mounting means adjacent its proximal end for selective movement between a first raised position, at which the distal ends are raised out of the water, and a second lowered position, at which the distal end is submerged in the water. A selectively energizable water propulsion means is operatively mounted on the support arm member adjacent to the distal end so as to be submerged in the water when the support arm is in the second lowered position. There is a longitudinal shroud member securely mounted on a selected one of the support arm member and the selectively energizable water propulsion means so as to at least partially surround the selectively energizable water propulsion means. The shroud member defines an internal throughpassage longitudinally extending between an inlet end and an outlet end, with the selectively energizable water propulsion means being positioned with respect to the shroud member so as to direct a propelled water stream through the throughpassage from the inlet end to the outlet end in generally parallel relation to the longitudinal axis of the shroud member, generally toward the submerged marine surface when the water propulsion means is energized and the support arm member is in the second lowered position. A first control means is operatively connected to the mounting means and the support arm member for controlling movement of the support arm member between the first raised and the second lowered positions. A second control means is operatively connected to the mounting means and the water propulsion means for selectively energizing the water propulsion means.

In accordance with another aspect of the present invention, there is provided a method of retarding the formation of marine plants and animals on marine surfaces submerged in water, the method comprising:

(a) lowering a support arm member having a selectively energizable water propulsion means operatively mounted thereon from a first raised position, at which the selectively energizable water propulsion means is raised out of the water, to a second lowered position, at which the selectively energizable water propulsion means is submerged in the water;

(b) selectively energizing the water propulsion means so as to direct a propelled water stream generally toward the marine surfaces submerged in water; and, (c) raising the support arm member having a selectively energizable water propulsion means operatively mounted thereon from a second lowered position, at which the selectively energizable water propulsion means is submerged in the water, to a first raised position, at which the selectively energizable water propulsion means is raised out of the water.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
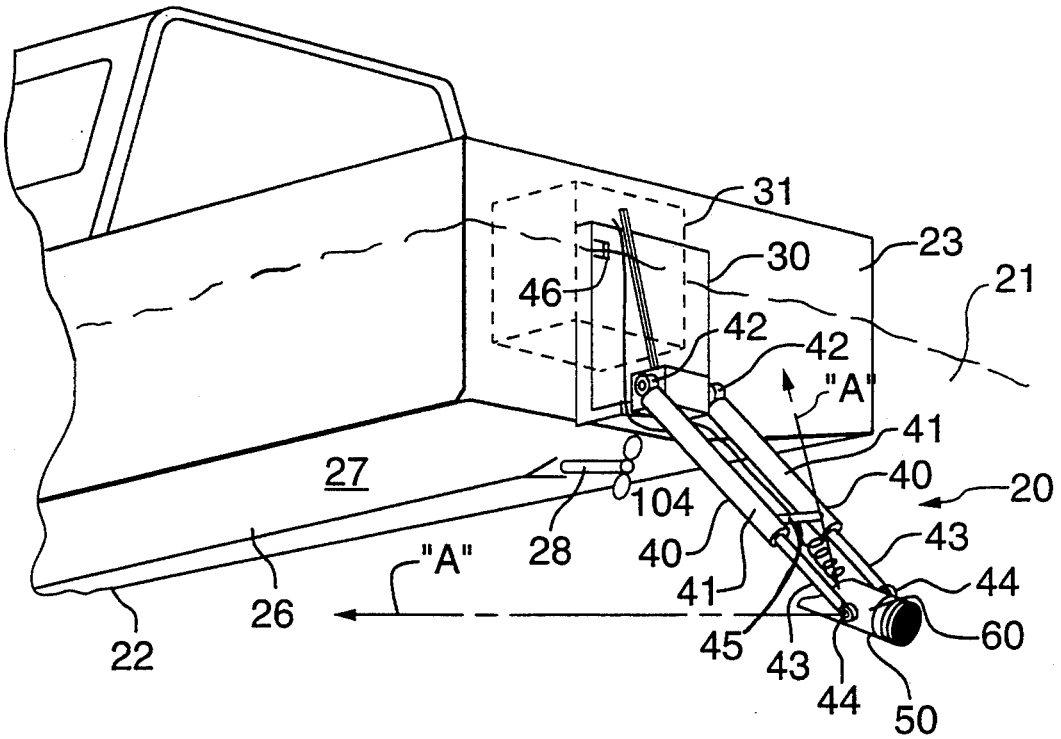
FIG. 1 is a partially cut-away perspective view of the anti-fouling apparatus according to the present invention installed on the rear of a marine craft, taken from the lower left rear of the marine craft, with the anti-fouling apparatus in a lowered position.
Figure 2:
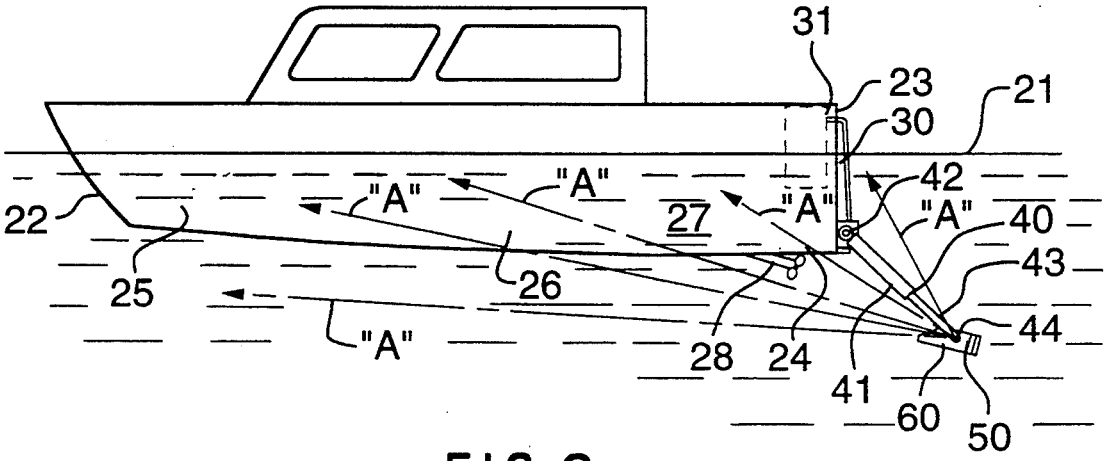
FIG. 2 is a side elevational view of the marine craft and the anti-fouling apparatus of FIG. 1.
Figure 3:
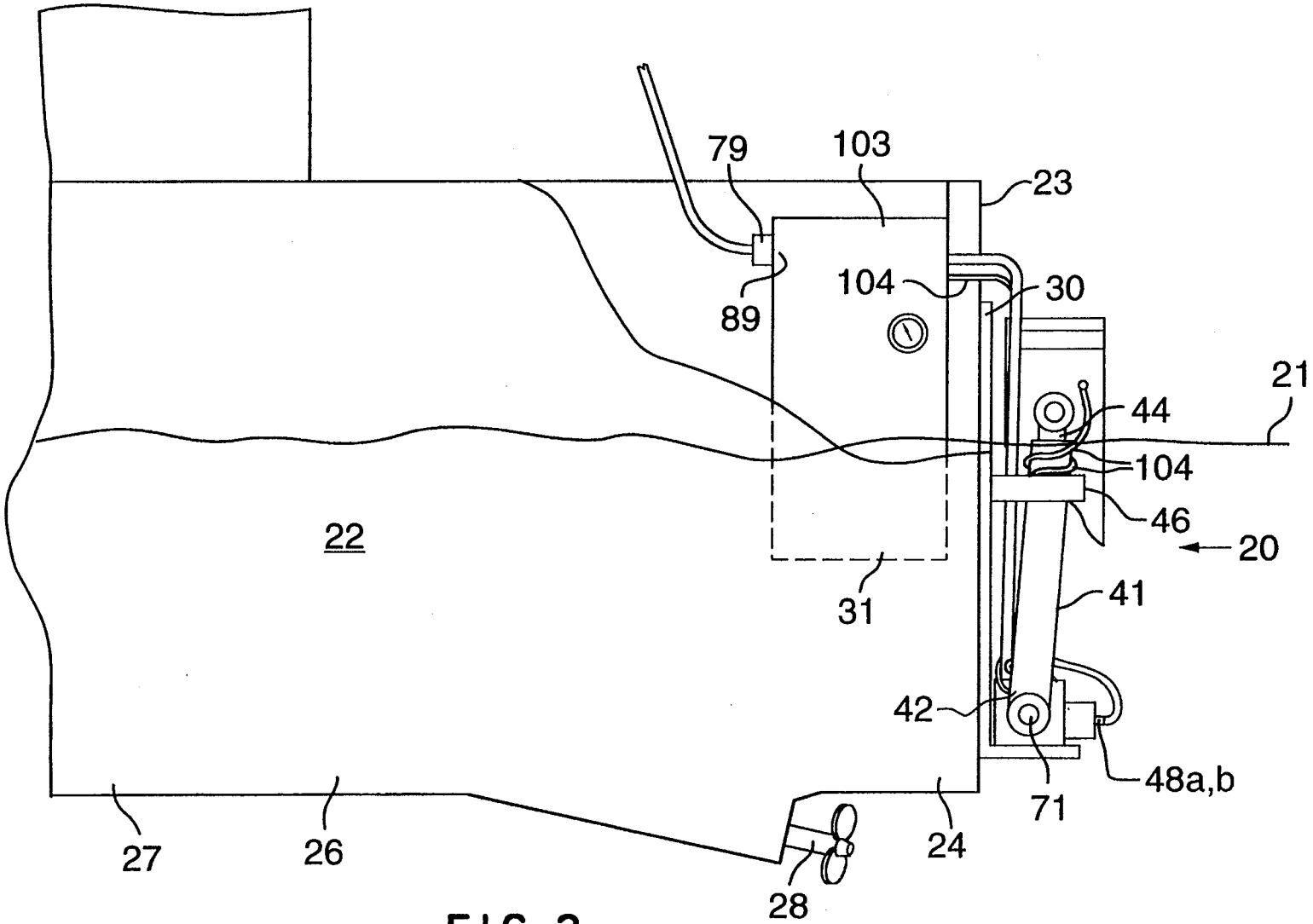
FIG. 3 is an enlarged partially cut-away side elevational view of the rear portion of the marine craft and anti-fouling apparatus of FIG. 1 mounted thereon, with the anti-fouling apparatus in a raised position.

Referring now to FIGS. 1 through 3 of the drawings, the anti-fouling apparatus of the present invention, as designated by the general reference numeral 20, is shown installed on a marine craft 22 at the rear transom 23 thereof. The anti-fouling apparatus 20 is shown in FIGS. 1 and 2 in a first lowered position, which first lowered position is the normal "in operation" position of the anti-fouling apparatus 20. In FIG. 3, the anti-fouling apparatus 20 is shown in a raised "stored" position. At this first lowered position the anti-fouling apparatus 20 is partially submerged in water 21 and is positioned and oriented so as to be able to direct a propelled water stream generally at the submerged marine surfaces 26 of the marine craft 22, including the hull, the running gear, the rudder, and the like, as indicated by arrows "A" in FIGS. 1 and 2. The purpose of the anti-fouling apparatus 20 is to retard the formation of marine plants and animals on marine surfaces 26 of the marine craft 22 submerged in water 21, or on the submerged marine surfaces of a dock (not shown).

The anti-fouling apparatus 20 is securely mounted to the submerged marine surfaces 26, specifically the rear transom 23 of the marine craft 22, or to another surface adjacent to the submerged marine surfaces 26 of the marine craft 22 by way of mounting means 30. The mounting means 30 is preferably formed from a rust, corrosion resistant material, such as high molecular weight polypropylene. The mounting means 30 is affixed to the rear transom 23 of the marine craft 22 by way of a plurality of conventional fastening means, preferably in the form of ½" diameter bolts (not shown), which bolts are also preferably m from a non-corroding material, such as stainless steel. A cooperating reinforcing bracket 31 is mounted against the inside face of the marine craft 22, so as to provide reinforcement for supporting the weight of the mounting means 30 and the anti-fouling apparatus 20 described below. The cooperating reinforcing bracket 31 is preferably also made from a material such as high molecular weight polypropylene.

Figure 4:
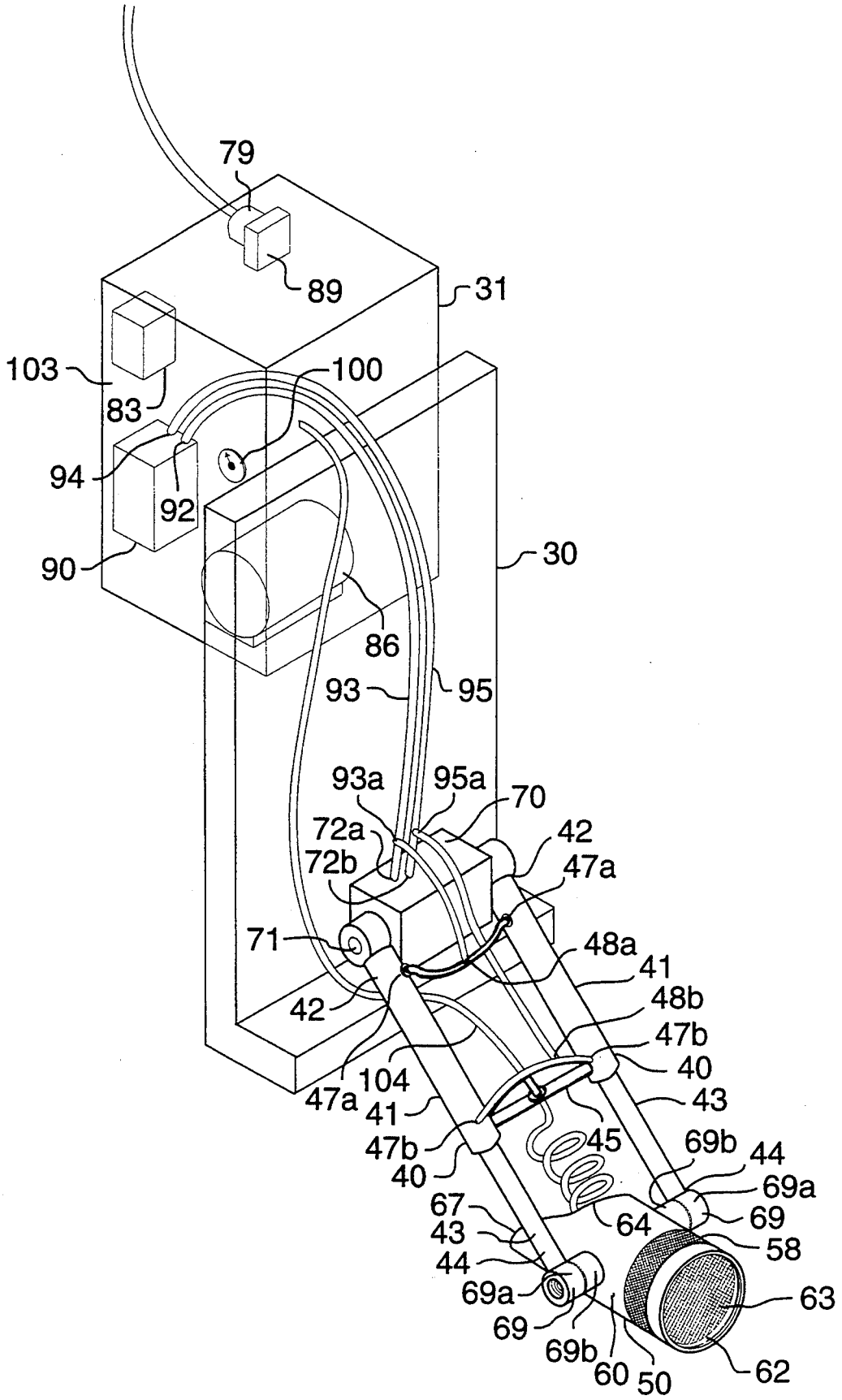
FIG. 4 is a perspective view of the anti-fouling apparatus of FIG. 1, in its lowered position, with the marine craft omitted for the sake of clarity.

Operatively mounted in pivotal relation to the mounting means 30 are a pair of generally linear support arm members 40, preferably in the form of telescopic pneumatic struts. The support arm members 40 each have a proximal end 42 and a distal end 44, and are pivotally, operatively mounted to the mounting means 30 at their proximal ends 42 for selected movement between a first raised position, as can be seen in FIG. 3, and a second lowered position, which can be best seen in FIGS. 1, 2 and 4. At the first raised position, the distal end 44 of each of the support arm members 40 is raised out of the water 21. A locking mechanism 46 comprises a pair of rubber, padded spaced apart arm members, which arm members are sized and configured to reasonably snugly retain one of the support arm members 40 in the first raised position. At the second lowered position, the distal end 44 of each of the support arm members 40 is submerged in the water 21. Each of the support arm members 40 comprises a cylinder 41 and a piston 43 slidably mounted within the piston in telescopically extending and retracting relation thereto so as to extend outwardly from the open end 41a of each of the cylinders 41. In this manner, the support arm members 40 are telescopically extendable from a first shorter length to a second longer length when moving from their first raised position to their second lowered position, and telescopically retractable from the second longer length to the first shorter length when moving from their second lowered position to their first raised position. The two cylinders 41 are securely braced to each other at their respective open ends **41*a* by way of a connecting brace 45, which connecting brace 45 provides for a more rigid structure, especially when the support arm members 40** are in their second lowered position.

A first control means 70 is operatively connected to the mounting means 30 and to the support arm members 40 for controlling the movement of the support arm member 40 between the first raised and the second lowered positions. In the preferred embodiment illustrated, the first control means 70 comprises a commercially available pneumatically actuated rotary motor operatively interconnected between the mounting means 30 and the proximal end 42 of the support arm member 40. The proximal end 42 of each of the support arm members 40 is conventionally mounted to opposed ends of a shaft member 71 of the pneumatically actuated rotary motor 70, for rotation with the shaft member 71. The use of a key and keyway arrangement (not shown) acting between each of the shaft ends 71 and the respective proximal end 42 is highly desirable in this regard. The pneumatically actuated rotary motor 70 is controlled by way of electric and pneumatic control circuitry, as can best be seen in FIG. 7, and as will be described in greater detail subsequently.

Operatively mounted on the distal end 44 of each of the support arm members 40 is a selectively energizable water propulsion means 50 in the preferred form of an electrically powered motor means 52 and a propeller means 54. The electrically powered motor means 52 is preferably rated at about one horsepower, but may range from about one-third horsepower to about two horsepower, or even more, depending on the size of the marine craft that the anti-fouling apparatus 20 upon which it is installed. The size and shape of the propeller means 54 may be determined through routine engineering design. When the support arm members 40 are in their second lowered position, the selectively energizable water propulsion means 50 is submerged in the water 21, so as to be positioned behind the rear transom 23 of the marine craft 22, which positioning allows the selectively energizable water propulsion means 50 to, in operation, retard the formation of marine plants and animals on marine surfaces 26 submerged in the water 21 according to the teachings of the present invention.

Figure 5:
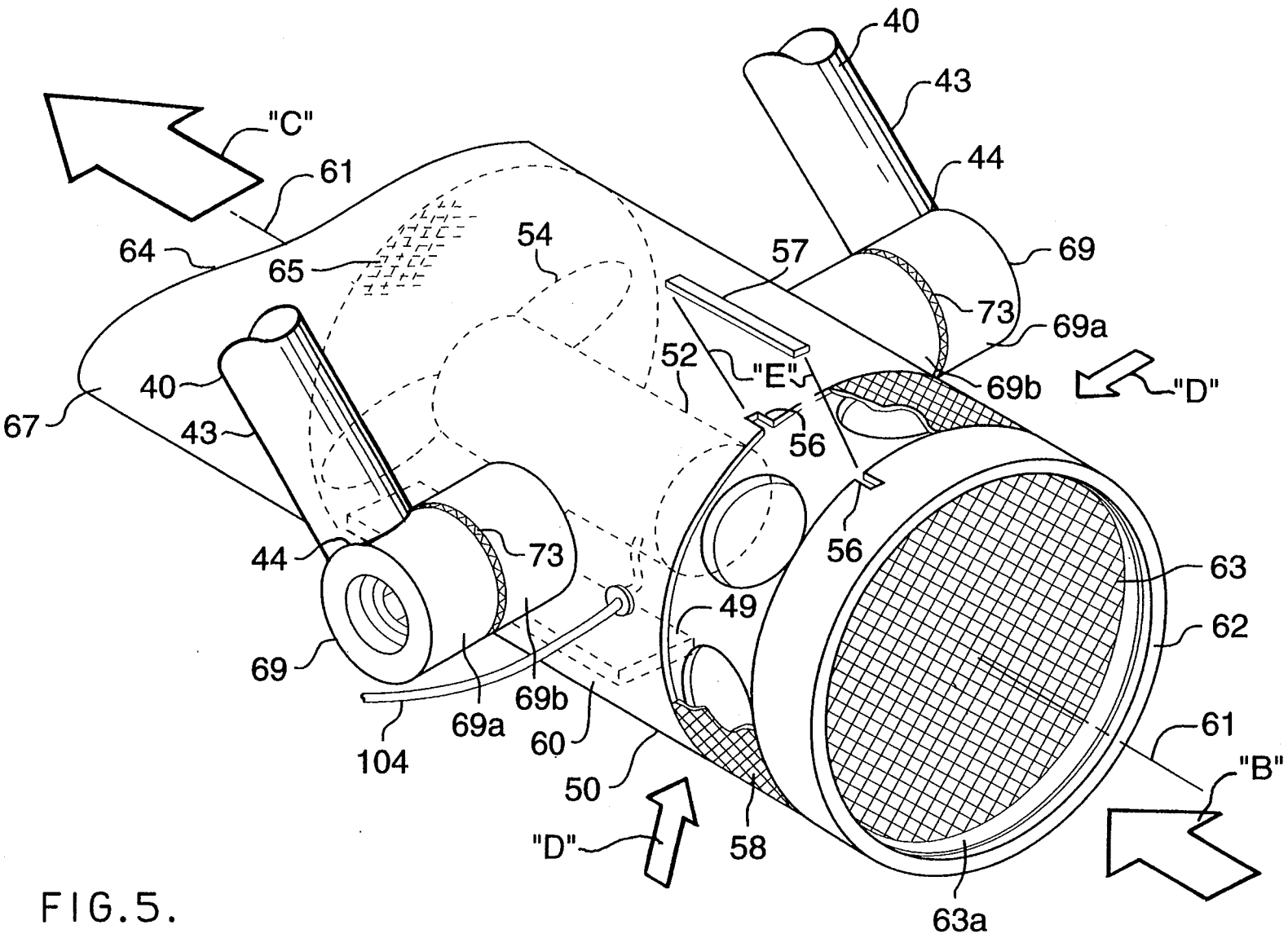
FIG. 5 is a perspective view of the water propulsion means and shroud member of the present invention of FIG. 1.

The selectively energizable water propulsion means 50 is surrounded by a longitudinal shroud member 60, which shroud member 60 is in the preferred embodiment illustrated, in the form of a hollow thin-walled cylinder, approximately 8" in diameter, with a wall thickness of approximately ½". In this manner, the shroud member 60 is shaped and dimensioned to generally direct the flow of water from the water propulsion means 50 and also to protect the water propulsion means 50. The longitudinal shroud member 60 has a longitudinal axis 61 displaced generally along the center-line thereof, an inlet end 62 and an outlet end 64, and defines an internal throughpassage 66 longitudinally extending along the longitudinal axis 61 from the inlet end 62 to the outlet end 64. The selectively energizable water propulsion means 50 is positioned with respect to the shroud member 60 so as to direct a propelled water stream through the throughpassage 66 from the inlet end 62, as indicated by arrow "B" of FIG. 5, to the outlet end 64, as indicated by arrow "C" of FIG. 5, in a generally parallel relation to the longitudinal axis 61 of the shroud member 60. Four radially disposed baffles 49 extend inwardly from the interior surface of the shroud member 60 so as to keep the flow of water through the shroud member 60 generally directed along the longitudinal axis 61, and so as to substantially preclude a swirling action within the shroud member 60. This propelled water stream is directed generally forwardly from the stern of the marine craft 22 to the bow of the marine craft, generally toward the submerged marine surfaces 26, when the water propulsion means 50 is energized and the support arm member 40 is in its second lowered position. In order to direct the propelled water stream thusly, the longitudinal axis 61 of the throughpassage 66 is oriented in intersecting relation to the marine surfaces 26, when the device is fully deployed to its "in operation" configuration.

Figure 6:
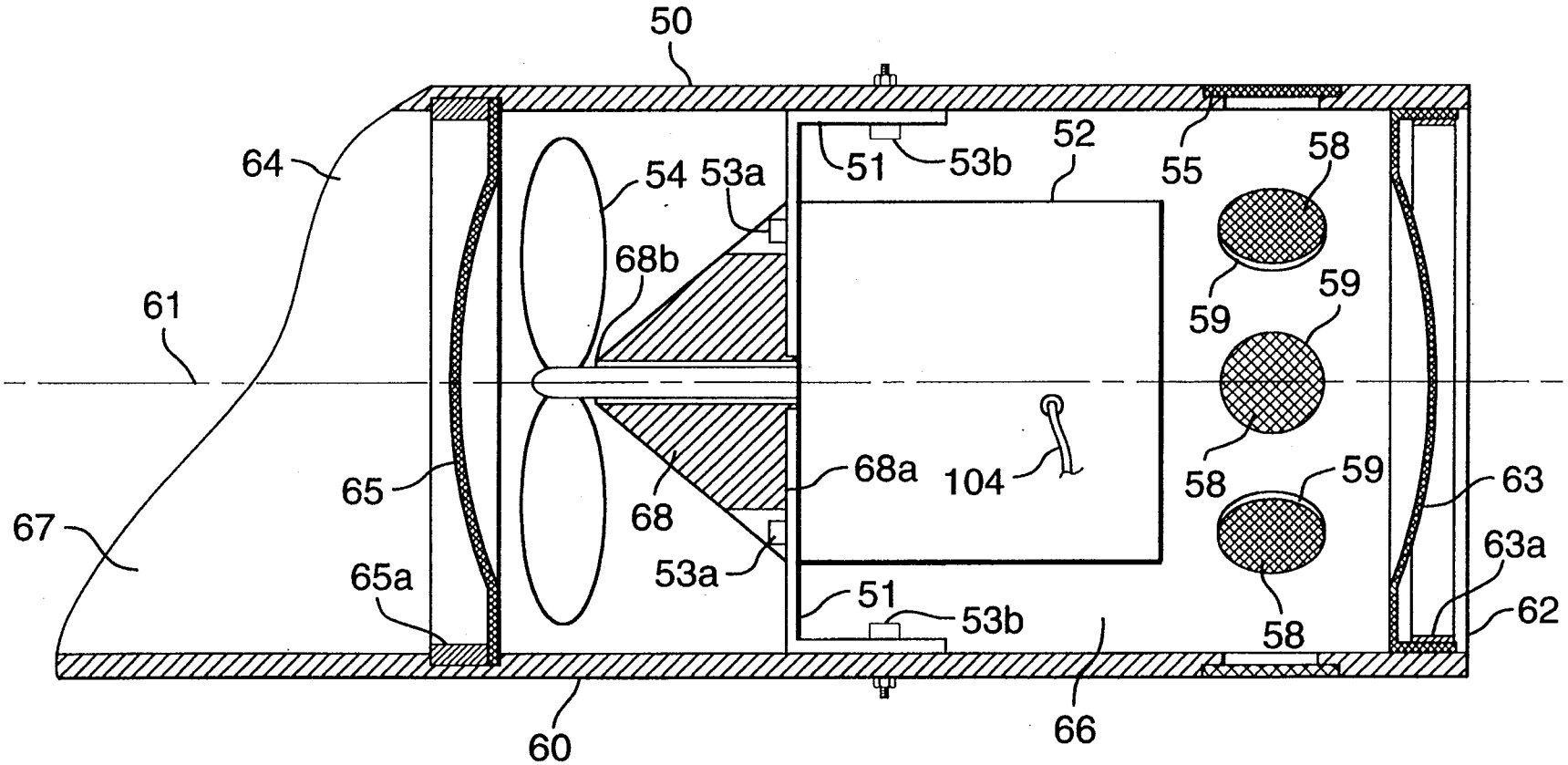
FIG. 6 is a sectional side elevational view of the water propulsion mans and shroud member of FIG. 5.

The electrically powered motor means 52 is mounted to the inside of the shroud member 60 by way of four evenly, radially spaced angle brackets 51, which angle brackets 51 are bolted to the electrically powered motor means 52 by bolts 53*a* and are bolted to the shroud member 60 by bolts 53*b* (see FIG. 6). There is preferably provided between the electrically powered motor means 52 and the propeller means 54 is a cone member 68 made form a material such as high molecular weight polypropylene, which cone member 68 is bolted to the angle brackets 51 at its base end 68*a* by bolts 53*a*. The apex end 68*b* of the cone member 68 is disposed adjacent to the propeller means 54. The cone member 68 precludes the formation of a low pressure area of water between the electrically powered motor means 52 and the propeller means 54 by physically filling the gap that would otherwise exist therebetween. Further, the cone member 68 is shaped and sized to permit a smooth, relatively laminar, flow of water between the electrically powered motor means 52 and the propeller means 54.

The distal ends 44 of each of the support arm members 40 are mounted to the shroud member 60 by way of respective selectively pivotal conventional couplings 69. The first cylindrical portion 69*a* of each of the couplings 69 is integral with the distal end 44 of the respective of the support arm members 40. The second cylindrical portion 69*b* of each of the couplings 69 is integral with the respective longitudinal shroud member 60, one on each opposed side of the longitudinal shroud member 60. The first cylindrical portion 69*a* of the couplings 69 of each of the support arm members 40 is mounted to the second cylindrical portion 69*b* of the respective coupling 69 by way of a recessed allen bolt 35. The first 69*a* and second 69*b* cylindrical portions of each of the couplings 69 have cooperating interfitting radially ribbed surfaces 73 that allow the first and second cylindrical portions 69*a*, 69*b* to lock in position with respect to each other at a variety of selected radial positions, thereby allowing the angular position of the shroud member 60 and selectively energizable water propulsion means 50 therein to be selectively set and subsequently retained thereat. In this manner, the longitudinal axis of the throughpassage 66 of the shroud member 60 may be oriented in intersecting relation to the to the marine surfaces 26 of the marine craft 22, such as the hull 27 and the running gear 28.

The shroud member 60 further comprises a first main filter screen 63 and a second main filter screen 65. The first 63 and second 65 main filter screens are preferably crowned at their centre for structural purposes. The first main filter screen 63 is operatively disposed in filtering relation over the inlet 62 of the throughpassage 66, and is held in place thereat in a groove 62*a* by a metal expansion ring 63*a*. Similarly, the second main filter screen 65 is operatively disposed over the outlet end of the throughpassage 60 and is held in place in a groove 64*a* by a metal expansion ring 65*a*. The first 63 and second 65 main filter screens are so placed to substantially preclude fish, seaweed, and other foreign objects and debris from entering into the interior of the longitudinal shroud member 60 and becoming caught in the propeller means 54.

Also provided in the longitudinal shroud member 60 are a plurality of secondary inlet openings 59 to the throughpassage 66. These secondary inlet openings 59 are situated within a cooperating annularly disposed channel 55, which channel 55 is adjacent to the inlet end 62, and are shaped and dimensioned so as to allow for auxiliary flow of water into the throughpassage 66 of the shroud member 60, as indicated by arrows "D" of FIG. 5. These secondary inlet openings 59 collectively have approximately the same cross-sectional area as the main filter screen 65 at the inlet end 62 of the throughpassage 66. An annularly disposed secondary filter screen 58 is operatively disposed within the annularly disposed channel 55, in filtering relation over the secondary inlet openings 59. The secondary filter screen 58 is held in place by a retaining bar 57, the ends of which are held in respective cooperating recesses 56 at opposed sides of the annularly disposed channel 55. The retaining bar 57 is shown being put into place, as indicated by arrows "E". The purpose of the secondary inlet openings 59 is to preclude the cessation of waterflow into the throughpassage 66 of the shroud member 60 by providing an auxiliary flow of water into the throughpassage in the event that the first main filter screen 63 becomes fully or partially clogged with debris. The second main filter screen 65 at the outlet end 64 of the throughpassage 66 is unlikely to become clogged, since the direction of water flow tends to push debris away from it. Thus, a secondary filter screen near the outlet end 64 is unnecessary.

At the outlet end 64 of the throughpassage 66, the longitudinal shroud member 60 terminates in an extension portion 67 at the bottom thereof. The extension portion 67 serves to assist in directing the propelled water stream generated by the selectively energizable water propulsion means 50 upwardly towards the marine surfaces 26 and also generally precludes a water stream from being propelled downwardly within the body of water 21, thus potentially disturbing the floor of the body of water 21.

Figure 7:
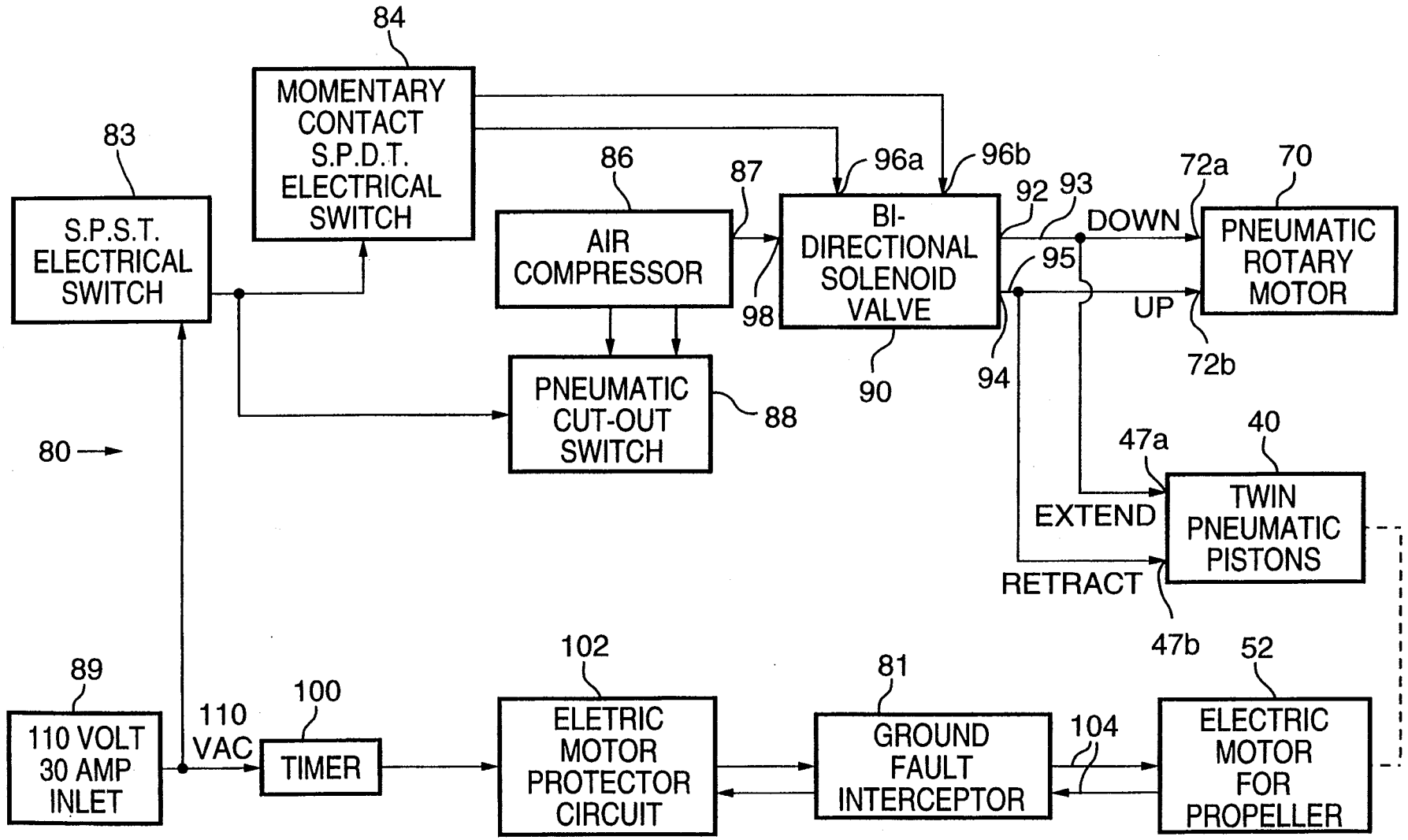
FIG. 7 is a functional block diagram of the control system of the present invention.

The electric and pneumatic control circuitry 80 for controlling the operation of the anti-fouling device 20 will now be discussed in greater detail with reference to FIG. 7. This control circuitry 80 is generally integrated within a small cabinet means 103 that is bounded on its rear face by the cooperating reinforcing bracket 31 (see FIG. 4). The control circuitry has an electrical energizing inlet 89 that is adapted to receive therein a conventional female electric plug 79, which conventional electric plug 79 is readily available for use while docked at virtually any marina. The power supplied by such plugs is at a voltage of about 110 volts AC, with a maximum current available of about 50 amperes. Alternatively, many marine craft are supplied with electrical generator units or convertors in order to provide electrical power at 110 volts AC. Such an electrical power source may, of course, be used as long as the electrical generator unit or convertor is operating.

The electrical power fed into the inlet 89 is fed to an air compressor 86 that supplies compressed air at a pressure of between 85 PSI and 100 PSI. A pneumatic cut-out switch 88 is an integral part of the air compressor 86 and is operatively connected thereto so as to receive compressed air that is output from the air compressor 86. Whenever the air compressor 86 is electrically energized, the pneumatic cut-out switch 88 causes the air compressor 86 to start if the air pressure at the output of the air compressor 86 is below about 85 PSI, and the pneumatic cut-out switch 88 causes the air compressor 86 to shut down if the air pressure at the output of the air compressor 86 is above about 100 PSI.

Interposed in operative relation between the inlet 89 and the air compressor 86 is a single pole single throw electrical switch 83 that functions as an ON-OFF switch. The electrical switch 83 is preferably located on the cabinet means 103, but may alternatively be located near the ignition switch (not shown) of the marine craft 22 for the sake of convenience, or may optionally be interconnected with the ignition switch to only operate when, for example, the engine (not shown) of the marine craft 22 is shut down. When the electrical switch 83 is turned on, electrical power is available to, inter alia, the air compressor 86.

Also electrically connected to the electrical switch 83 is a momentary contact single pole double throw electrical switch 84. The electrical switch 84 is operatively electrically connected to first **96*a* and second 96*b* electrical inputs of a bi-directional solenoid valve 90 so as to selectively feed electrical power to the bi-directional solenoid valve 90. The output 87 of the air compressor 86 is operatively connected in fluid communication to a pneumatic input 98 of the bi-directional solenoid valve 90. Compressed air from the air compressor 86 is fed into the bi-directional solenoid valve 90, which bi-directional solenoid valve 90 selectively routes the compressed air out of either a first output port 92 or out of a second output port 94**.

The first output port 92 of the bi-directional solenoid valve 90 is connected in fluid communication to a first input **72*a* of the pneumatic rotary motor 70 by way of a first output conduit 93 and to a first input 47*a* of each of the support arm members 40 by way of the first input conduit 93, which first input conduit 93 is split in to two branches by a "Y" connector 93*a*, such that one of the two branches connects to the first input 47*a* on one of the support arm members 40, and the other of the two branches connects to the first input 47*a* on the other of the support arm members 40. Supplying compressed air to the first input 72*a* of the pneumatic rotary motor 70 causes the pneumatic rotary motor 70 to rotate in a first direction. Supplying compressed air to the first inputs 47*a* of the support arm members 40 causes the support arm members 40** to extend from their first shorter length to their second longer length.

The second output port 94 of the solenoid valve 90 is connected in fluid communication to a second input **72*b* of the pneumatic rotary motor 70 by way of a second input conduit 95. A second input 47*b* of each of the support arm members 40 by way of the second input conduit 95, which second input conduit 95 is split in to two branches by a "Y" connector 95*a*, such that one of the two branches connects to the second input 47*b* on one of the support arm members 40, and the other of the two branches connects to the first input 47*a* on the other of the support arm members 40. Supplying compressed air to the second input 72*b* of the pneumatic rotary motor 70 causes the pneumatic rotary motor 70 to rotate in a second direction. Supplying compressed air to the second inputs 47*b* of the support arm members 40** to retract from their second longer length to their first shorter length.

In use, in order to raise the support arm members 40 from their first raised position to their second lowered position, with the electrical switch 83 in its "ON" configuration, the momentary contact single pole double throw electrical switch 84 is actuated to a first "DOWN" position. The bi-directional solenoid valve 90 is correspondingly configured such that the compressed air from the air compressor 86 is directed through the first output port 92 to the first input **72*a* of the pneumatic rotary motor 70, and to the first inputs 47*a* of the support arm members 40. The pneumatic rotary motor 70 is thereby caused to rotate in a first direction, thus causing the support arm members 40 to lower towards their second lowered position until a pre-set angular position (determined by the design specifications of the pneumatic rotary motor 70) is reached, at which pre-set angular position the selectively energizable water propulsion means 50 is in place, or nearly in place, submerged within the water 21. The compressed air concurrently reaches the first inputs 47*a* of the support arm members 40 and starts to urge the support arm members 40 from their first shorter length to their second longer length. In actuality, this extension of the support arm members 40 does not occur until the support arm members 40 have been rotated by the pneumatic rotary motor 70 nearly to a horizontal position, due to the original upward orientation of the support arm members 40 and due to the weight of the water propulsion means 50 and the shroud member 60**.

At this pre-set angular position, the pneumatic rotary motor 70 stops rotating due to a built-in angular limitation therein, and the air pressure from the bi-directional solenoid valve 90 to the support arm members 40, so as to extend the support arm members 40 until they have reached their fully extended length, at which point the support arm members 40 are in their second lowered position. After the support arm members 40 have extended, the air pressure from the air compressor 86 builds past a pressure of about 100 PSI since the compressed air is not released, except perhaps at a very slow leakage rate. At a pressure of about 100 PSI, the pneumatic cut-out switch 88 is activated so as to electrically turn off the air compressor 86.

In order to raise the support arm members 40 from their second lowered position to their first raised position, thereby causing the selectively energizable water propulsion means 50 to lift out of the water, the momentary contact single pole double throw electric switch 84 is actuated to a second "UP" position. The bi-directional solenoid valve 90 changes state so as to direct the compressed air to the second output port 94, which second output port 94 is in fluid communication with the second inputs **47*b* of the support arm members 40. The compressed air from the air compressor 86 is directed through the second output port 94 to the second input 47*b* of the support arm members 40, so as to cause the support arm members 40 to retract until their first shorter length is reached. At that first shorter length of the support arm members 40, the selectively energizable water propulsion means 50 is raised out of, or nearly raised out of, the water 21. Concurrent with the retraction of the support arm members 40, the compressed air tends to urge the rotary motor 70 to rotate in a second direction opposite to the aforementioned first direction. Typically, the rotary motor 70 cannot lift the water propulsion means 50 and the shroud member 60 until the support arm member 40 are in their first shorter length. This delay in raising the support arm members 40 by way of the rotary motor 70 is due to moment of the water propulsion means 50 and the shroud member 60 about the pivot point of the support arm members 40 at the proximal end 42 thereof. As the support arm members 40 reach their first shorter length, the moment arm is shortened sufficiently enough so as to decrease the moment of the water propulsion means 50 and the shroud member 60 to a point where the rotary motor 70 can raise the support arm members 40, the water propulsion means 50 and the shroud member 60**.

After the rotary motor 70 has rotated until the support arm members 40 are in their second raised position, the air pressure from the air compressor 86 builds past a pressure of about 100 PSI since the compressed air is not released. At a pressure of about 100 PSI, the pneumatic cut-out switch 88 is activated so as to electrically turn off the air compressor 86.

Once the selectively energizable water propulsion means 50 is in place in the water, it is ready to be selectively energized so as to be operational. The selective energization of the selectively energizable water propulsion means 50 is controlled by a timer 100, which timer 100 is electrically connected to the inlet 89. The output of the timer 100 is electrically connected to a protector circuit 102, which is in turn electrically connected to the electric motor means 52 through a conventional ground fault intercepter 81. The ground fault intercepter 81 stops the flow of electricity to the electric motor means 52 in the event of electrical leakage from the ground terminal of the electrical motor means 52. The ground fault interceptor 81 is electrically connected to the electric motor means 52 by way of a suitable electrical cable 104 that is preferably chemical and salt resistant. The timer 100 is set for energizing the water propulsion means 50 at given intervals for set periods of time, with the given intervals preferably being no more than three hours, depending on the local fouling conditions of the water. The timer 100 does not operate if a plug is not plugged into the electrical inlet 89.

It will be understood by those skilled in the art that other alternative embodiments other than the embodiment specifically described above, fall within the spirit and scope of the appended claims. In one such alternative embodiment, it is contemplated that the anti-fouling apparatus of the present invention comprises a mounting means that is affixed to a dock and the marine surfaces include the hull and running gear of a marine craft moored adjacent to the dock. In this embodiment, the mounting of the selectively energizable water propulsion means on the support means would possibly have to be routinely modified to adjust the orientation of such means visa vis the hull and running gear of the marine craft, as for example, by rotating such mounting through 90° so as to achieve proper operative intersection of the water flow from the shroud means with the hull and running gear as aforesaid. Such modifications are, however, easily determined through non-inventive routine design modifications.

We claim:

1. An anti-fouling apparatus for retarding the formation of marine plants and animals on marine surfaces submerged in water, said apparatus comprising:

a mounting means affixed to said marine surface or to another surface adjacent to said marine surface;

a support arm member having a proximal end and a distal end, operatively mounted on said mounting means adjacent its proximal end for selective movement between a first raised position, at which said distal end is raised out of said water, and a second lowered position, at which said distal end is submerged in said water;

a selectively energisable water propulsion means operatively mounted on said support arm member adjacent to said distal end so as to be submerged in said water when said support arm is in said second lowered position;

a longitudinal shroud member adjustably mounted on a selected one of said support arm member and said selectively energisable water propulsion means so as to at least partially surround said selectively energisable water propulsion means, said shroud member defining an internal throughpassage longitudinally extending between an inlet end and an outlet end, with said selectively energisable water propulsion means being positioned with respect to said shroud member so as to selectively direct a propelled water stream through said throughpassage from said inlet end to said outlet end in generally parallel relation to the longitudinal axis of said shroud member, generally toward said submerged marine surfaces when said water propulsion means is energized, said shroud member is appropriately adjusted about its mounting, and said support arm member is in said second lowered position;

a first control means operatively connected to the mounting means and the support arm member for controlling movement of said support arm member between said first raised and said second lowered positions; and, a second control means operatively connected to the mounting means and the water propulsion means for selectively energizing said water propulsion means.

2. The device of claim 1, wherein said anti-fouling apparatus is mounted on a marine craft and said marine surfaces include the hull and running gear of said marine craft.

3. The device of claim 2, wherein said mounting means is affixed to the rear transom of a marine craft and said selectively energizable water propulsion means is positioned behind said rear transom when said support arm member is in said second lowered position.

4. The apparatus of claim 3, wherein said propelled water stream is directed generally forwardly from the stern of said marine craft to the bow of said marine craft.

5. The apparatus of claim 4, wherein said longitudinal axis of said throughpassage is oriented in intersecting relation to said marine surfaces.

6. The apparatus of claim 5, wherein said support arm member is pivotally mounted on said mounting means.

7. The apparatus of claim 6, wherein said first control means is pneumatically actuated.

8. The device of claims 7, wherein said first control means comprises a pneumatically actuated rotary motor operatively interconnected between said mounting means and the proximal end of said support arm member.

9. The device of claim 8, wherein said support arm member is telescopically extendable from a first shorter length to a second longer length when moving from said first raised position to said second lowered position and telescopically retractable from said second longer length to said first shorter length when moving from said second lowered position to said first raised position.

10. The device of claim 9, comprising a pair of generally parallel support arm members connected at their respective distal ends to transversely opposite sides of said selectively energizable water propulsion means.

11. The device of claim 10, wherein said support arm members are each telescopic pneumatic struts.

12. The device of claim 11, wherein said second control means includes a timer to automatically control energization of said selectively energizable water propulsion means.

13. The device of claim 11, wherein said selectively energizable water propulsion means comprises motor means and propeller means.

14. The apparatus of claim 13, wherein said motor means is electrically powered.

15. The apparatus of claim 13, wherein said motor means is pneumatically powered.

16. The apparatus of claim 13, wherein said motor means is hydraulically powered.

17. The device of claim 1, wherein said shroud member further comprises a first main filter screen and a second main filter screen operatively disposed over said inlet and said outlet ends of said throughpassage respectively.

18. The device of claim 17, wherein a plurality of secondary inlet openings to said throughpassage are provided in the shroud member in generally transverse relation to said longitudinal axis adjacent to said inlet end, and wherein a secondary filter screen is operatively disposed over each of said secondary inlet openings.

19. The device of claim 18, wherein said secondary inlet openings collectively have approximately the same cross-sectional area as the inlet end of said throughpassage.

20. The device of claim 1, wherein said shroud member is mounted on the distal end of said support arm member.

21. A method of retarding the formation of marine plants and animals on marine surfaces submerged in water, said method comprising:

(a) lowering a support arm member having a selectively energizable water propulsion means operatively mounted thereon from a first raised position, at which said selectively energizable water propulsion means is raised out of said water, to a second lowered position, at which said selectively energizable water propulsion means is submerged in said water;

(b) selectively energizing said water propulsion means so as to direct a propelled water stream generally toward said marine surfaces submerged in water; and, (c) raising said support arm member having a selectively energizable water propulsion means operatively mounted thereon from a second lowered position, at which said selectively energizable water propulsion means is submerged in said water, to a first raised position, at which said selectively energizable water propulsion means is raised out of said water.

* * * * *